US006301942B1

(12) United States Patent
Shvarts

(10) Patent No.: US 6,301,942 B1
(45) **Date of Patent: *Oct. 16, 2001**

(54) ACCESSORIES FOR A MODULAR REMOVABLE CORE CYLINDER ASSEMBLY

(75) Inventor: Vladimir Shvarts, Woodmere, NY (US)

(73) Assignee: Arrow Lock Manufacturing Company, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,900

(22) Filed: Apr. 3, 2000

Related U.S. Application Data

(63) Continuation of application No. 09/122,083, filed on Jul. 24, 1998, now Pat. No. 6,079,240.

(51) Int. Cl.[7] ..... E05B 27/00; E05B 29/00; E05B 33/00

(52) U.S. Cl. ..... 70/367; 70/417; 70/450; 70/405; 70/409

(58) Field of Search ..... 70/367–373, 417, 70/493, 494, 495, 450, 452–455, 423, 405, 406, 409, 420, 421; 403/381

(56) References Cited

U.S. PATENT DOCUMENTS

| | | | | |
|---|---|---|---|---|
| Re. 31,910 | | 6/1985 | Oliver | 70/369 |
| Re. 35,518 | | 5/1997 | Sussina | 70/369 |
| 959,854 | * | 5/1910 | Grierson | 403/381 |
| 1,422,594 | | 7/1922 | Maxwell | 70/417 |
| 1,568,462 | | 1/1926 | Moritz et al. | 70/373 |
| 1,575,092 | | 3/1926 | Best | 70/373 |
| 1,656,854 | | 1/1928 | Best | 70/369 |
| 2,287,175 | | 6/1942 | Heyer | 70/495 |
| 2,457,650 | | 12/1948 | Dyson | 70/381 |
| 3,197,985 | | 8/1965 | Cosio | 70/419 |
| 3,298,211 | | 1/1967 | Russell | 70/369 |
| 3,429,154 | | 2/1969 | Schwartz | 70/375 |
| 3,492,842 | | 2/1970 | Schlage | 70/369 |
| 3,928,991 | | 12/1975 | Gaul et al. | 70/364 A |
| 4,282,731 | | 8/1981 | Taksony | 70/364 A |
| 4,321,811 | | 3/1982 | Ziegler | 70/356 |
| 4,328,690 | | 5/1982 | Oliver | 70/369 |
| 4,356,713 | | 11/1982 | Widen | 70/364 A |
| 4,478,061 | | 10/1984 | Preddey | 70/358 |
| 4,603,565 | | 8/1986 | Strassmeir | 70/358 |
| 4,703,638 | | 11/1987 | Bergstrom | 70/369 R |
| 4,715,201 | | 12/1987 | Craig | 70/369 |
| 4,732,023 | | 3/1988 | Shen | 70/383 |
| 4,756,177 | | 7/1988 | Widen | 70/367 A |
| 4,815,307 | | 3/1989 | Widen | 70/493 |
| 4,867,598 | * | 9/1989 | Winter, IV | 403/381 |
| 4,900,090 | * | 2/1990 | Davis | 403/381 |
| 4,920,774 | | 5/1990 | Martin | 70/367 |
| 5,016,455 | | 5/1991 | Hennessy | 70/493 |
| 5,067,335 | | 11/1991 | Widen | 70/495 |

(List continued on next page.)

FOREIGN PATENT DOCUMENTS 9603562 2/1996 (WO) .

*Primary Examiner*—Lynne H. Browne
*Assistant Examiner*—John B. Walsh
(74) *Attorney, Agent, or Firm*—Sughrue, Mion, Zinn, Macpeak & Seas, PLLC

(57) ABSTRACT

A removable core cylinder assembly utilizes a plurality of modular parts to create a key-removable interchangeable core which will fit all existing interchangeable core locks of this kind. The removable core cylinder assembly includes accessories of a removable face plate which covers an axial recess in the cylinder shell for the locking tab and provides shelter to the head of the cylinder plug, and which is protected from removal from the cylinder shell by two stepped portions of the cylinder plug; and a key which includes a stop at the end of the tip of the key blade.

4 Claims, 5 Drawing Sheets

U.S. PATENT DOCUMENTS

| | | | | |
|---|---|---|---|---|
| 5,123,268 | * | 6/1992 | Eizen | 70/359 |
| 5,176,015 | | 1/1993 | Sussina | 70/369 |
| 5,209,087 | | 5/1993 | Cox | 70/369 |
| 5,211,044 | | 5/1993 | Kim | 70/371 |
| 5,233,851 | | 8/1993 | Florian | 70/367 |
| 5,291,767 | | 3/1994 | Weindorf et al. | 70/370 |
| 5,383,344 | | 1/1995 | Zambell | 70/209 |
| 5,421,179 | | 6/1995 | Bergstrom | 70/369 |
| 5,431,034 | | 7/1995 | Fann et al. | 70/369 |
| 5,433,416 | * | 7/1995 | Johnson | 403/381 |
| 5,507,163 | | 4/1996 | Juang | 70/369 |
| 5,572,890 | | 11/1996 | Carpenter | 70/371 |
| 5,582,050 | | 12/1996 | Haggstrom | 70/495 |
| 5,615,566 | * | 4/1997 | Brandt | 70/419 |
| 5,640,865 | | 6/1997 | Widen | 70/495 |
| 5,737,948 | | 4/1998 | Lefkovits | 70/164 |
| 5,762,410 | * | 6/1998 | Lutz | 403/381 |
| 5,813,260 | | 9/1998 | Widen | 70/369 |
| 5,884,512 | * | 3/1999 | Wayne | 70/370 |
| 5,943,890 | * | 8/1999 | Field et al. | 70/493 |
| 6,023,954 | * | 2/2000 | Field | 70/409 |
| 6,079,240 | * | 6/2000 | Shvarts | 70/367 |
| 6,155,090 | * | 12/2000 | Rubensson | 70/367 |

* cited by examiner

ACCESSORIES FOR A MODULAR REMOVABLE CORE CYLINDER ASSEMBLY

This is a continuation of application Ser. No. 09/122,083 filed Jul. 24, 1998, now U.S. Pat. No. 6,079,240, the disclosure of which is incorporated herein by reference.

The present invention relates to a modular type removable core cylinder assembly with locking tab (locking sleeve) having the same number of pin chambers as the cylinder shell and the cylinder plug, and which utilizes a plurality of modular parts to create a key-removable interchangeable core which will fit all existing interchangeable core locks of this kind.

BACKGROUND OF THE INVENTION

Conventional removable core cylinders are removable from a lock housing under the control of a control key for removing and e.g., replacing, the core. An operating key, or master key, is used to operate the lock in its normal condition and does not affect the removability of the core. Conventional removable cores utilize conventional pin tumblers which are evenly spaced in a single row along the length of the key barrel, which make removable cores subject to "picking" and thus, limiting the security they can afford. Conventional removable core cylinders are also more subject to security violations with unauthorized duplicated control keys.

Key-removable, interchangeable cores permit unskilled persons to rekey locks (i.e., block-out existing locks) without opening the door or removing the lock from the door. The cylinder is removed from the lock housing through the use of a control key, and a different interchangeable core cylinder of the same manufacturer can then be inserted into the lock housing, whereby the user can quickly and easily change a lock or locks without calling a locksmith.

Interchangeable cores are pinned for release from their housings by a single control key. The control key is actually a "top" master key whose sole function is limited to operation of the locking tab which retains the core in the lock housing. Interchangeable core control keys are not visually distinguishable from other keys in the system. Typically, the core is also pinned to one or more master keys and to a tenant key. Such a system usually requires three or four pin segments in each pin column; an arrangement which offers very limited pick-resistance.

Key-removable, interchangeable cores are manufactured by most American lockmakers. However, core interchangeability is usually limited to the housings of a single manufacturer.

High security locks include at least two mutually independent lock systems and are manipulated by different codes on one and the same key. The blade of the key to the system lock has a first, conventional code which coacts with the pin tumblers in the cylinder.

One of the high security features is the use of an independent locking mechanism on the side of the key—a sidebar—which is mounted in the radially outer part of the plug and which coacts with a row of side tumblers positioned laterally in the cylinder plug. The side bar prevents the cylinder from operating, should the top pins be "picked". The side bar also provides the system owner with an exclusive key that is controlled by the factory.

The side tumblers in the sidebar are manipulated by a code provided on a side-part of the key, which when the key is inserted into the lock, engages a region of the side tumblers. When the correct key is inserted, the first-mentioned tumblers form a dividing plane between the cylinder plug and the cylinder shell and the side tumblers are moved to positions in which a radially and inwardly directed control part on the sidebar is enabled to engage waisted portions on the tumblers, such that the sidebar will move into the plug against the action of a spring force as the plug is rotated by means of the key.

Examples of sidebars used in conventional removable core cylinder assemblies, are disclosed in Widen (U.S. Pat. No. 4,356,713), Cox (U.S. Pat. No. 5,209,087), and Oliver (U.S. Pat. No. 3,298,211, Re. 31,910).

Although no standardization exists with respect to all manufacturers of removable cores, there have been some improvements in the prior art with respect to standardization of face plates which cover one end of the cylinder shells, such as that described in Best (U.S. Pat. No. 1,575,092).

Removable core cylinders with locking tabs (locking or control sleeves) having the same number of pin chambers as the cylinder shell and cylinder plug, and having a face plate permanently assembled to the front of the cylinder shell, and manufactured by Arrow, Best, Falcon, KSP, Medeco, and others, have been standardized. This subset of removable cores is called interchangeable cores. The majority of lock manufacturers make interchangeable core locks which accept interchangeable core cylinders of different manufacturers.

As an example of the prior art standardized interchangeable core cylinder assemblies, FIG. 1 discloses a FIG. 8-shaped outer cylinder shell 1, permanently assembled with a face plate 12 to cover the axial recess provided for the locking tab 3 and to create a bearing surface for the head of the cylinder plug 4, a control sleeve 2 having the locking tab 3 formed thereon fitted in the cylinder shell and which also serves as a housing for the cylinder plug 4, a rotatable key barrel or plug 4 which is fitted in the sleeve 2, and a key stop disc or retainer 5, which is similar to that described in Sussina (U.S. Pat. No. 5,176,015, Re. 35,518), and also Russell et al (U.S. Pat. No. 3,298,211), and Juang (U.S. Pat. No. 5,507,163). The control key 6 has a stop 13 and cannot be withdrawn from the core unless the locking tab 3 is in the extended (locking) position. The pin stacks 7 in the removable core cylinder lock assembly 8 include bottom pins 9 which are radially adjusted within the bores 10 by corresponding bittings 11 cut in the top edge of the key 6.

As can be seen from the prior art in FIG. 1, the locking tab 3 is integrally formed with the control sleeve 2, which means that the outer cylinder shell 1, in order to provide for the sleeve 2, has thin walls that are subject to deformation.

Further, another problem in the prior art is that, although the sidebar concept is used in removable core cylinder locks to provide greater security, standardized interchangeable cores have no room for the sidebars—thus limiting the convenience of using an interchangeable core.

Further, permanent assembly of the cylinder shell and the face plate, thin walls of the cylinder shell and ultra thin walls of the control sleeve forces the manufacturers to sell interchangeable cores only as one complete assembly. This leads to duplication in inventory based on finish and keyway, which add to distributors inventory costs.

Accordingly, there is no existing interchangeable core cylinder which has modular parts which can be purchased separately and the core built to an end-user's needs, wherein the modular elements are independently sturdy, and wherein the interchangeable core can provide the greater security of a sidebar feature.

SUMMARY OF THE INVENTION

An object of the present invention is to provide a modular type removable core cylinder assembly with locking tab having the same number of pin chambers as the cylinder shell and the cylinder plug, and which utilizes a plurality of modular parts to create a key-removable interchangeable core which will fit all existing interchangeable core locks of this kind.

The removable core cylinder assembly according to a first embodiment of the present invention includes a cylinder shell having an axial bore formed therein, the axial bore having an axial recess formed along an axial length of the axial bore; a cylinder plug rotatably mounted within the cylinder shell and having two stepped portions at the front end thereof, wherein the second stepped portion has a smaller outer diameter and uses the front of the cylinder shell as a bearing surface; a locking tab seated within the axial recess of the cylinder shell, which locks the interchangeable core in the lock housing; a removable face plate which covers the axial recess in the cylinder shell for the locking tab, and provides shelter to the head (front end) of the cylinder plug; and a retainer which holds all the parts together and provides the stop for the key.

The provision of the novel locking tab, instead of a control sleeve with an integral locking tab, wherein the sleeve has thin walls which can deform, means that the walls of the cylinder shell of the present invention can be made thicker.

The modular design of the present invention allows more flexibility and cost savings in the production process, and yields a much stronger core in that, unlike other interchangeable cores, each modular element is independently sturdy.

The modular design of the present invention also saves distributors inventory costs, since the parts can be purchased separately and the core built according to the end-user's needs. There is no longer a need for a permanent assembly for each interchangeable core. Further, the modular new removable core cylinder assembly of the present invention will fit all existing interchangeable core locks of this kind.

The removable core cylinder lock assembly also features a novel high security option. One of the modules, the face plate, can be conventionally made or manufactured as drill resistant. The drill resistant face plate will meet high security core cylinder requirements with the addition of hardened steel pins.

Further, in the conventional interchangeable core cylinders, a permanent assembly of the face plate and cylinder shell was required when the face plate was inserted, and machining took place after this assembly. This machining was required to provide the bearing surface for the head of the cylinder plug.

In the present invention, the face plate is able to be machined and finished separately, prior to assembly, because the bearing surface for the cylinder plug is provided by the cylinder shell.

The removable core cylinder assembly according to a second embodiment of the present invention includes a cylinder plug rotatably mounted within the cylinder shell and having a sidebar projecting from an opening in an outer peripheral surface of the cylinder plug; wherein the cylinder shell has an opening in the axial bore for accommodating the sidebar; and a locking tab disposed in the cylinder shell, which locks the interchangeable core cylinder within the lock housing.

In the present invention, a sidebar can be used in the interchangeable core cylinder, by drilling one of the blind bores in the cylinder plug to accommodate the tail piece, which connects the core to a lock, shorter than the other (or drilling both blind bores shorter). The side bar prevents the cylinder from operating, should the top pins be "picked". The side bar also provides the system owner with an exclusive key that is controlled by the factory—an important security feature.

BRIEF DESCRIPTION OF THE DRAWINGS

Other features and advantages of the invention will be apparent from the following description taken in connection with the accompanying drawings, wherein.

DETAILED DESCRIPTION OF THE PREFERRED EMBODIMENTS

Figure 2:
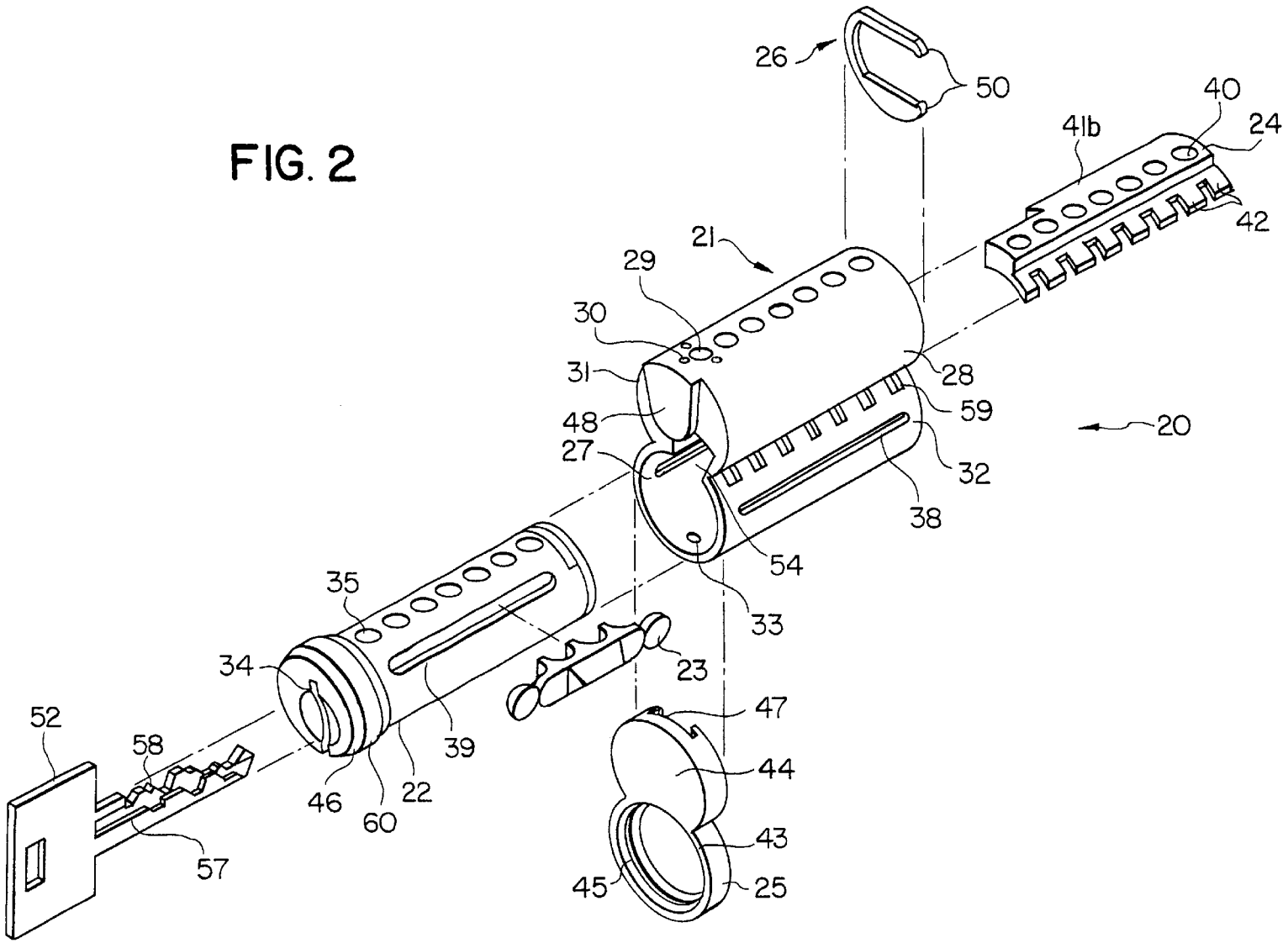
FIG. 2 shows an exploded view of the modular removable core cylinder assembly according to the present invention.
Figure 3:
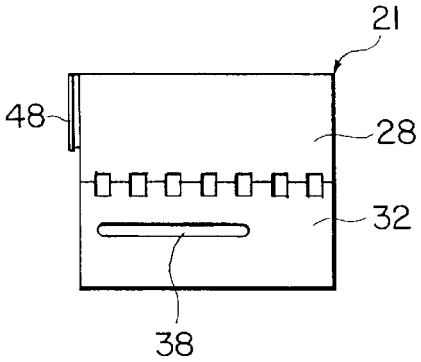
FIG. 3 shows a side elevational view of the cylinder shell showing the slot to receive the sidebar.

A completed assembly of the first embodiment of the modular removable core cylinder assembly 20 of the present invention is described as follows, and is shown in FIG. 2. The same reference numerals as those shown above represent the same elements.

The removable core cylinder assembly 20, as depicted in FIG. 2, includes a removable core cylinder shell 21, a cylinder plug 22 with a sidebar 23, a locking tab 24, a face plate 25, and a retainer 26.

Figure 1:
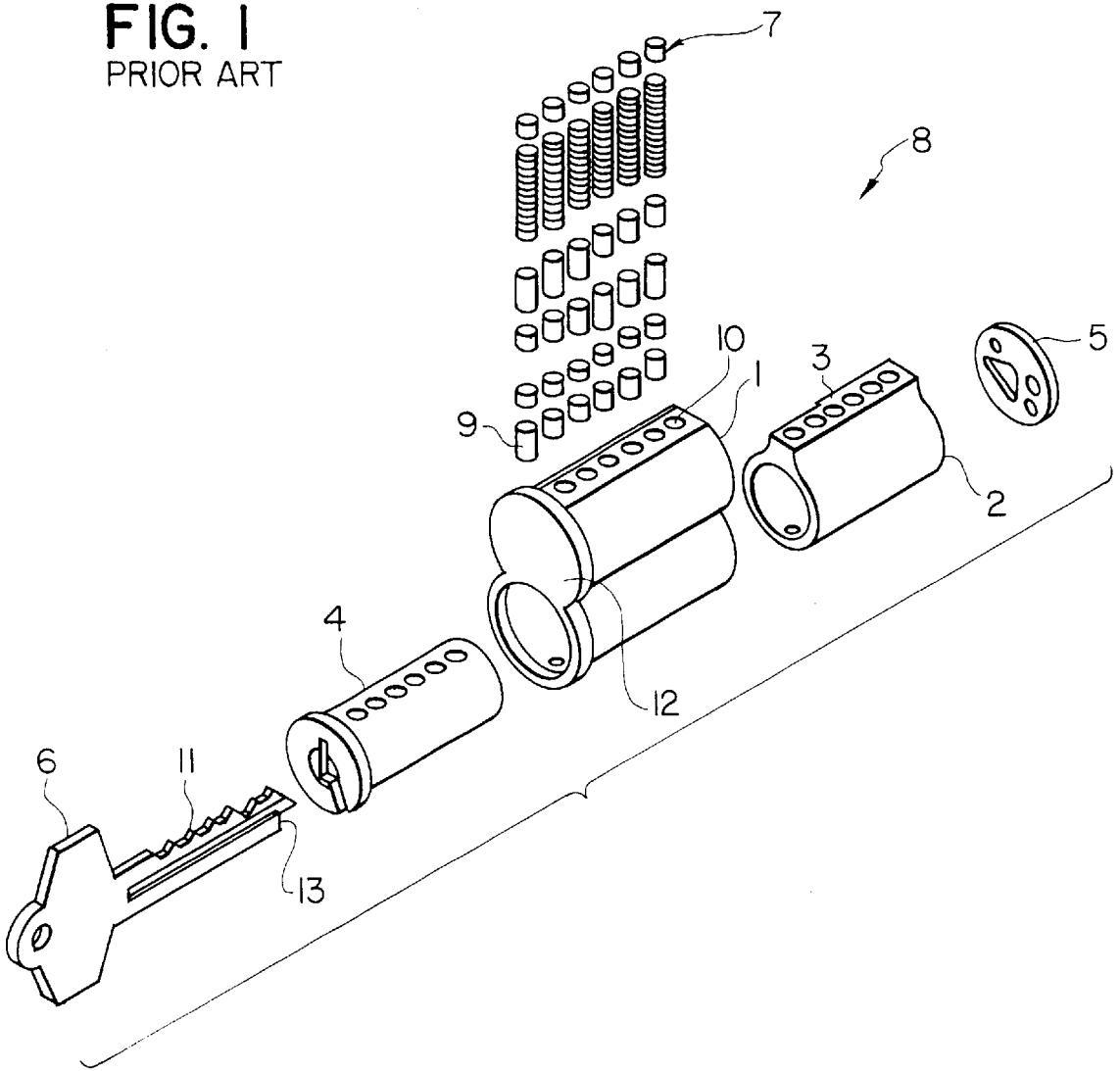
FIG. 1 PRIOR ART
FIG. 1 shows a prior art interchangeable core assembly.
Figure 4:
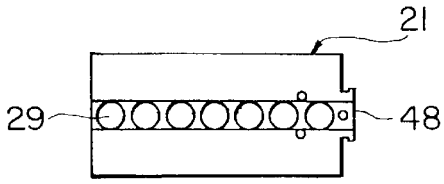
FIG. 4 shows a top plan view of the cylinder shell.
Figure 8:
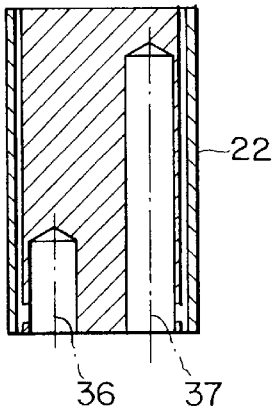
FIG. 8 shows a sectional view taken from line 8—8 at FIG. 7, showing the bores for the tailpiece (keyway not shown).

The removable core cylinder shell 21 has a cylindrical body in the shape of a FIG. 8, with an 5 axial bore 27 formed therein. The cylinder shell 21 has an upper portion 28 which includes a plurality of axially-spaced radially-extending pinholes 29 for receiving pin stacks 7 (see FIGS. 1 and 4).

Three small holes 30 are provided at a head portion of the cylinder shell 21 around the pinhole 29 closest to the front face 31 of the cylinder shell 21, for the disposition of hardened pins (not shown), which are provided during assembly to provide drill resistance for the core assembly 20.

The lower portion 32 of the cylinder shell 21 has a plurality of pin knockout holes 33 through which a tool is introduced to forcibly remove tumblers from the core assembly prior to rekeying.

Figure 9:
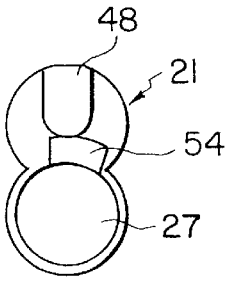
FIG. 9 shows a front elevational view of the cylinder shell with the locking tab in place.
Figure 16:
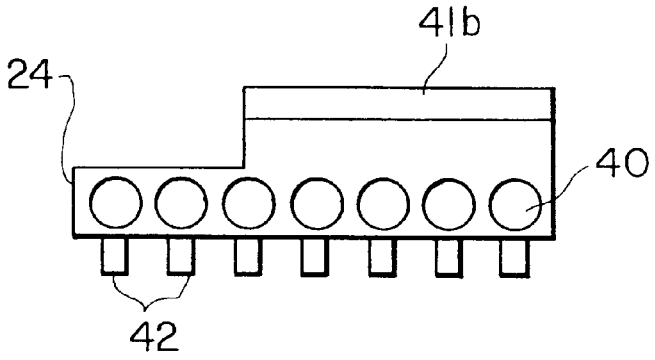
FIG. 16 shows a front elevational view of a locking tab with an extended rectangular projection.
Figure 17:
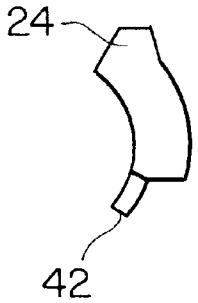
FIG. 17 shows a side elevational view of the locking tab with the extended rectangular projection.

The cylinder shell 21 includes a recess 54 in its upper portion (see FIGS. 2 and 9) which runs the axial length of the axial bore 27, in which the locking tab 24 is seated (described later).

Figure 6:
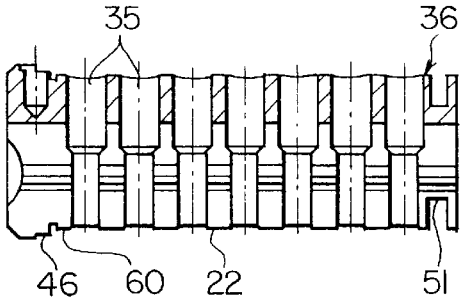
FIG. 6 shows a sectional view taken from line 6—6 at FIG. 5.

The cylinder plug 22 is mounted in the axial bore 27 in the lower portion of the cylinder shell 21 for rotation. The cylinder plug 22 includes a keyway 34 and a plurality of axially-spaced, radially-extending pinholes 35 communicating with the keyway 34, each pinhole 35 opening onto an outer surface of the plug 22. The number of pinholes 35 in the cylinder plug 22 corresponds to the number of pinholes 29 in the upper portion of the cylinder shell 21, and preferably, but not necessarily, numbers 6 to 7 pinholes (see FIG. 6).

Figure 5:
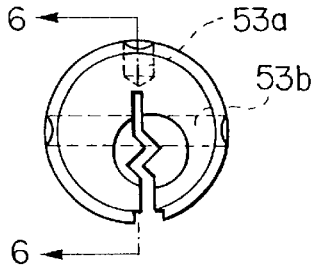
FIG. 5 shows a front elevational view of a cylinder plug.

The front portion of the cylinder plug 22 has a blind bore 53*a* and a bore 53*b* (see FIG. 5) for the insertion of three hardened pins (not shown) to strengthen the drill resistance of the front face of the cylinder plug 22.

The front portion of the cylinder plug 22 also has a first stepped portion 46 and a second stepped portion 60, wherein the second stepped portion 60 has a smaller outer diameter than the first stepped portion 46, with both stepped portions preventing the face plate 25 from being removed when the cylinder plug 22 is in place. The shoulder of the second stepped portion 60 uses the front of the cylinder shell 21 as a bearing surface.

Figure 7:
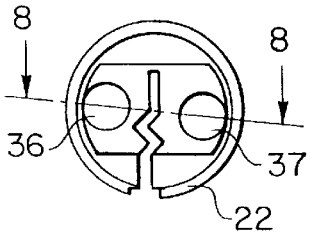
FIG. 7 shows a rear elevation of the view shown in FIG. 5.

The cylinder plug 22 includes two longitudinally extending blind bores 36, 37 (see FIGS. 7 and 8) bored parallel to the keyway 34 from the rear portion 36 of the barrel of the cylinder plug 22, which engage with corresponding prongs of a tailpiece (not shown), all of which are rotatably disposed in the cylinder shell 21, to operate the lock mechanism as the key turns.

A locking tab 24 having a curved tab body is provided to lock the removable core in the lock housing (see FIGS. 14–17).

The locking tab 24 also has the same number of pinholes 40 as that of the cylinder plug 22 and cylinder shell 21, and has a rectangular projection 41*a* or 41*b* (see FIGS. 14 and 16) on one side of the tab body 24, and a plurality of tooth-like projections 42 on the other side of the tab body 24 (see FIGS. 14–17).

Figure 18:
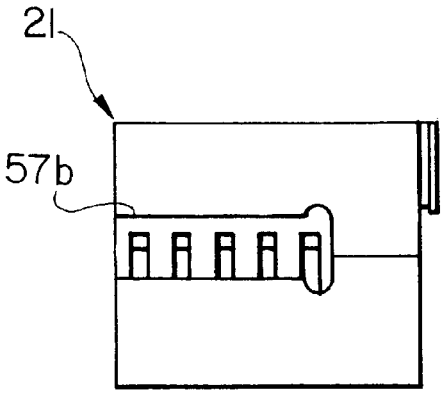
FIG. 18 shows a side elevational view of the is cylinder shell showing an opening to receive the locking tab with the extended rectangular projection.
Figure 13:
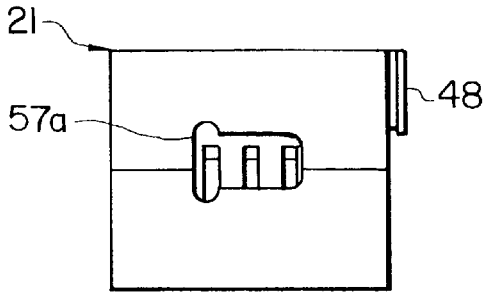
FIG. 13 shows a side elevational view of the cylinder shell showing an opening to receive the locking tab having a central rectangular projection.
Figure 14:
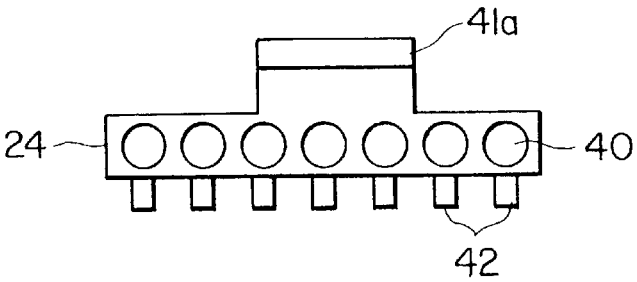
FIG. 14 shows a front elevational view of a locking tab with a central rectangular projection.
Figure 15:
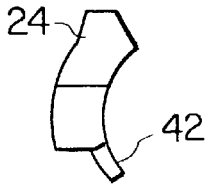
FIG. 15 shows a side elevational view of the locking tab with a central rectangular projection.
Figure 2:
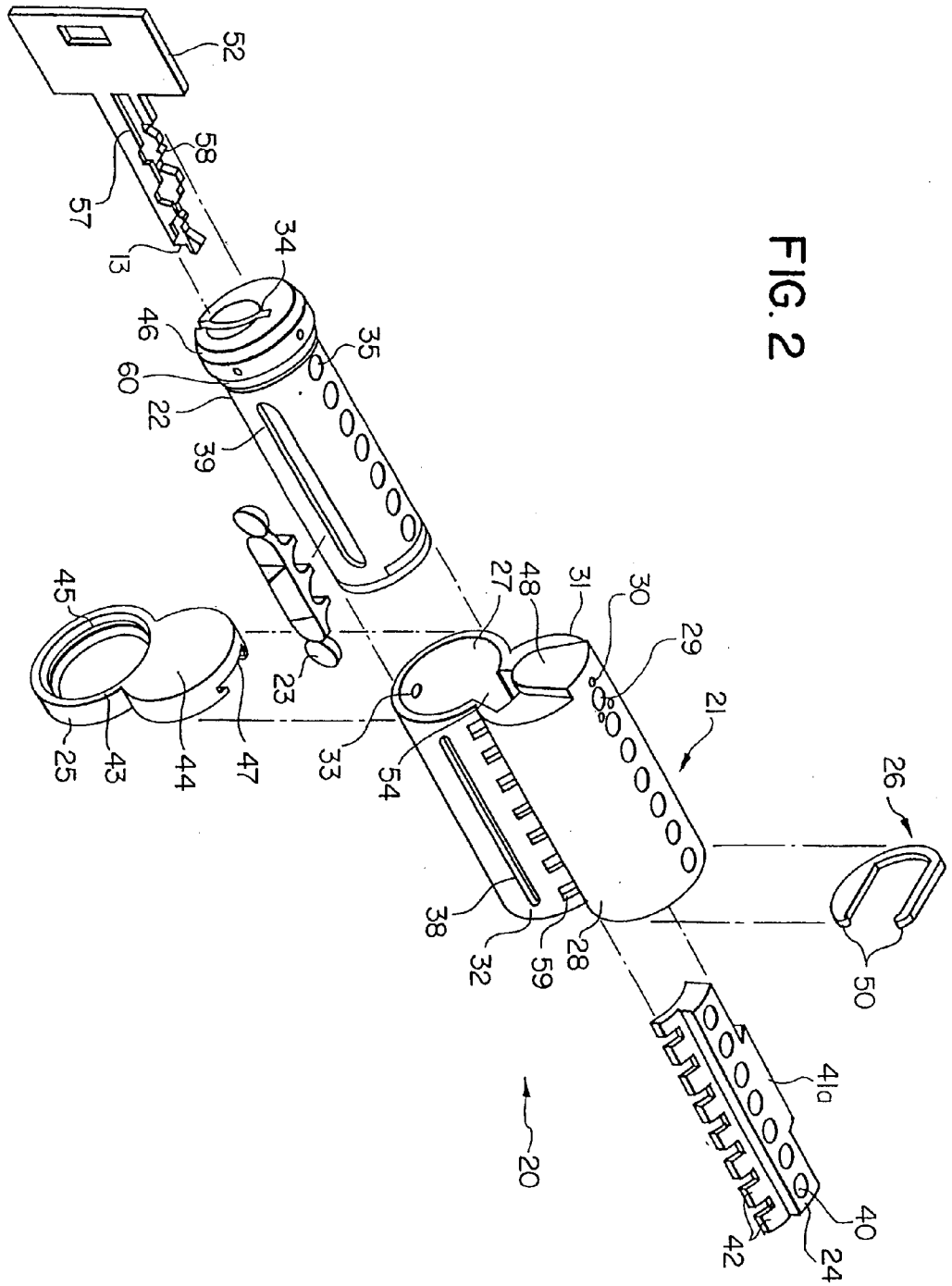

When the locking tab 24 is disposed in the recess 54 of the axial bore 27, the rectangular projection of the tab body 24, which is preferably either an extended rectangular projection (see FIGS. 16 and 17), or more preferably, a central rectangular projection (see FIGS. 14 and 15), according to which embodiment is being used, is disposed in either the opening 57*a* (see FIG. 13) or the opening 57*b* (see FIG. 18), respectively, of the cylinder shell 21.

Figure 11:
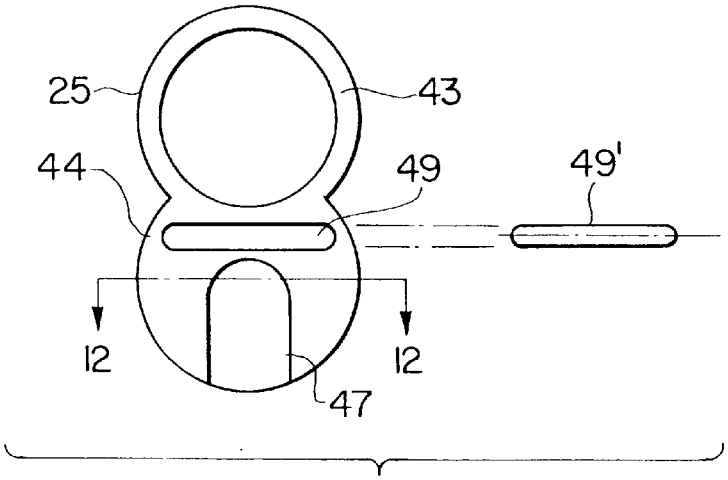
FIG. 11 shows a rear elevation of the face plate with a hardened metal pin or bar at the side.
Figure 12:
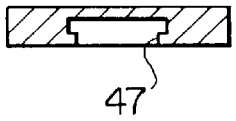
FIG. 12 shows a sectional view taken on line 12—12 at FIG. 11 showing the recessed portion.

A face plate 25 is provided to protect the locking tab 24, and is inserted over the cylinder shell 21 at the front face 31 (see FIG. 11). The face plate 25 has a ring portion 43 and a solid portion 44. The ring portion 43 has an inner stepped portion 45 which engages with the first stepped portion 46 of the front portion of the cylinder plug 22. The solid portion 44 has a recessed portion (i.e. dovetail slot) 47 which slidably engages with the raised projection 48 of the cylinder shell 21 at the front face 31 of the upper portion 28. The slotted recess 49 disposed between the ring portion 43 and the recessed portion 47, is provided for the disposition of a hardened pin or bar 49' which provides drill resistance for the removable core assembly 20.

A substantially U-shaped retainer 26 with arms 50, is provided as a key stop, and also to retain the cylinder plug 22 in the core assembly. The retainer arms 50 slide into the slotted portions 51 (see FIG. 6) on either side of the end face of the rear portion of the cylinder plug 22, when the plug 22 is inserted in the cylinder shell 21.

An operating key 52 is provided with a stop 13 at the end of the tip of the key blade. When the operating key 52 is inserted in the keyway 34 at the front portion of the plug 22, the operating key 52 aligns the divisions between selected pin segments to coincide at the cylinder plug barrel periphery. The cylinder plug 22 interfaces with the connecting elements (not shown) which extend or withdraw a lock bolt (not shown) as the key turns.

Figure 10:
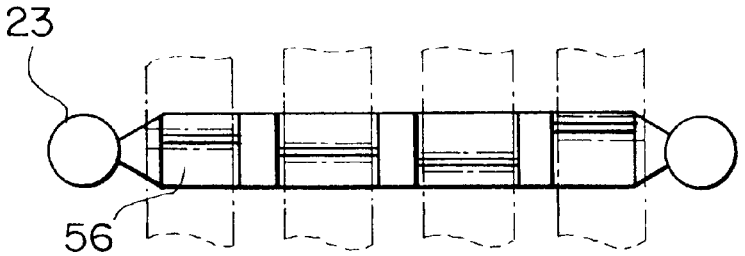
FIG. 10 shows a front elevational view of the sidebar with the side tumbler pins in phantom lines.

According to a second embodiment of the present invention, an optional sidebar 23 is disposed within the plug 22, by making one bore 36 shorter than the second bore 37. The sidebar 23 projects through an opening 39 of the cylinder plug 22 (see FIG. 2), and when inserted in the cylinder shell 21, the sidebar 23 projects through sidebar opening 38 (see FIG. 2) in the cylinder shell 21. Each side tumbler pin has a groove to accept the sidebar 23. The sidebar 23 is coded, so the grooves 56 of the sidebar 23 are disposed in different places (see FIG. 10). The cuts 57 in the key blade of the operating key 52 match the sidebar 23. If the cuts 57 in the key 52 do not match the sidebar 23, it protrudes from the opening 38 in the cylinder shell 21 to prevent the cylinder plug 22 from turning, even if the key 52 has the right cuts 58 in the top portion of the key blade.

The removable core cylinder lock assembly is assembled as follows.

The locking tab 24 is axially inserted into the cylinder shell 21, such that the outer curved face of the locking tab body 24 rests on the floor of the inner recess 54, the rectangular projection 41a or 41b of the locking tab 24 is inserted through the opening 25 57*a* or 57*b* of the cylinder shell 21, and the tooth-like projections 42 of the locking tab 24 are inserted into the slots 59 disposed in the axial crease of the cylinder shell 21. The pinholes 40 in the locking tab 24 align with the pinholes 29 in the upper portion 28 of the cylinder shell 21. Note that the locking tab 24 has the same number of pinholes 40 as that of the pinholes 35 in the cylinder plug 22, and that of the pinholes 29 in the cylinder shell 21. Although the locking tab 24 fits in the recess 54, there can be some play between the locking tab 24 and the side walls of the recess 54, which allow for rotation of the locking tab 24 together with the cylinder plug 22, when the control key is introduced.

The face plate 25 is then attached to the cylinder shell 21 by sliding the face plate 25 with its recessed portion 47 in contact with the front face 31 of the cylinder shell 21, in a direction vertical to the front face 31 of the cylinder shell 21, such that the raised projection 48 of the cylinder shell 21 slidably engages with the recessed portion 47 of the face plate 25.

The cylinder plug 22 is then inserted into the axial bore 27 of the cylinder shell 21 at the front portion through the opening 45 of the face plate 25, such that the pinholes 35 of the cylinder plug 22 align with the pinholes 40 of the locking tab 24, and the pinholes 29 of the cylinder shell 21 and the second step 60 rests on the front portion of the cylinder shell 21. The insertion of the cylinder plug 22 into the cylinder shell 21 is halted at the front portion by the second stepped portion 60, and both the first stepped portion 46 and the second stepped portion 60 of the cylinder plug 22 are seated in the inner stepped portion 45 of the ring portion 43 of the face plate 25, preventing the face plate from being removed. When the cylinder plug 22 is inserted in the cylinder shell 21 to form the cylinder core, the first and second bore openings 36, 37 are slightly tilted from the horizontal plane (see FIG. 7), and the slotted grooves 51 in the cylinder plug 22 protrude from the rear portion of the cylinder shell 21.

The substantially U-shaped retainer 26 is then inserted with its arms 50 into the slotted portions 51 of the cylinder plug 22 which protrude from the cylinder shell 21 at the rear portion of the shell 21. The retainer 26 holds the cylinder plug 22 in place within the cylinder core.

In operation, the cylinder plug 22 is rotatable in the cylinder shell 21, and when the operating key 52 is inserted into the cylinder plug 22, the cylinder plug 22 turns inside the cylinder shell 21 to release the lock.

If the sidebar 23 option is used, when the cylinder plug 22 rotates within the cylinder shell 21, the sidebar 23 is released from the opening 38, and pushed into opening 39.

It is contemplated that numerous modifications may be made to the apparatus and procedure of the invention without departing from the spirit and scope of the invention as defined in the following claims.

What is claimed is:

1. A removable face plate for transverse slidable engagement with a cylinder shell for a removable core cylinder assembly which is disposed in a lock housing, said face plate having a front side and a back side, said face plate comprising:

a ring portion;

a solid portion;

wherein said ring portion has a stepped portion at an inner periphery of said ring portion;

a grooved recess disposed within said solid portion proximate to said ring portion on said back side of said face plate said grooved recess being open on said back side of said face plate; and a hardened pin disposed in said grooved recess.

2. A removable face plate for transverse slidable engagement with a cylinder shell for a removable core cylinder assembly which is disposed in a lock housing, said face plate having a front side and a back side, said face plate comprising:

a ring portion;

a solid portion;

wherein said ring portion has a stepped portion at an inner periphery of said ring portion;

a grooved recess disposed within said solid portion proximate to said ring portion on said back side of said face plate; and a horseshoe-shaped dovetail slot disposed in said solid portion on said back side of said face plate, proximate to said grooved recess.

3. An operating key in combination with a removable core cylinder assembly, said removable core cylinder assembly comprising a cylinder shell, cylinder plug, a retainer to retain the cylinder plug in the removable core cylinder assembly and operative as a key stop, side tumblers and a sidebar having grooves, the sidebar being disposed in said cylinder plug, said key comprising:

a key blade having first cuts at a top portion of the key blade along its longitudinal length and second cuts at a side of the key blade along its longitudinal length, and one end including a tip; and a stop provided proximate to said tip of the key blade;

wherein said grooves of said sidebar and said second cuts at the side of said key blade align said side tumblers with said sidebar such that said cylinder plug can turn and operate said lock, when said stop abuts said key stop.

4. An operating key in combination with a removable core cylinder assembly, said removable core cylinder assembly comprising a cylinder shell, cylinder plug, a retainer to retain the cylinder plug in the removable core cylinder assembly and operative as a key stop, locking tab, side tumblers and a sidebar having grooves, the sidebar being disposed in said cylinder plug, and said locking tab having a limited circumferential extent within and extending along an entire axial length of an axial recess of said cylinder shell, said key comprising:

a key blade having first cuts at a top portion of the key blade along its longitudinal length and second cuts at a side of the key blade along its longitudinal length, and one end including a tip; and a stop provided proximate to said tip of the key blade;

wherein said grooves of said sidebar and said second cuts at the side of said key blade align said side tumblers with said side bar such that said cylinder plug can turn and operate said lock, when said stop abuts said key stop.

* * * * *

UNITED STATES PATENT AND TRADEMARK OFFICE

CERTIFICATE OF CORRECTION

PATENT NO. : 6,301,942 B1
DATED : October 16, 2001
INVENTOR(S) : Vladimir Shvarts It is certified that error appears in the above-identified patent and that said Letters Patent is hereby corrected as shown below:

Title page,
The title page, showing the illustrative figure, should be deleted and substitute therefor the attached title page.

Drawings,
Sheet 2 of 5, FIG. 2, should be deleted to be replaced with the attached.

Signed and Sealed this

Twenty-fifth Day of June, 2002

*Attest:*

*Attesting Officer*

JAMES E. ROGAN
*Director of the United States Patent and Trademark Office*

(12) United States Patent
Shvarts

(10) Patent No.: US 6,301,942 B1
(45) **Date of Patent: *Oct. 16, 2001**

(54) ACCESSORIES FOR A MODULAR REMOVABLE CORE CYLINDER ASSEMBLY

(75) Inventor: Vladimir Shvarts, Woodmere, NY (US)

(73) Assignee: Arrow Lock Manufacturing Company, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,900

(22) Filed: Apr. 3, 2000

Related U.S. Application Data

(63) Continuation of application No. 09/122,083, filed on Jul. 24, 1998, now Pat. No. 6,079,240.

(51) Int. Cl.[7] ..... E05B 27/00; E05B 29/00; E05B 33/00

(52) U.S. Cl. ..... 70/367; 70/417; 70/450; 70/405; 70/409

(58) Field of Search ..... 70/367–373, 417, 70/493, 494, 495, 450, 452–455, 423, 405, 406, 409, 420, 421; 403/381

(56) References Cited

U.S. PATENT DOCUMENTS

| | | | |
|---|---|---|---|
| Re. 31,910 | 6/1985 | Oliver | 70/369 |
| Re. 35,518 | 5/1997 | Sussina | 70/369 |
| 959,854 * | 5/1910 | Grierson | 403/381 |
| 1,422,594 | 7/1922 | Maxwell | 70/417 |
| 1,568,462 | 1/1926 | Moritz et al. | 70/373 |
| 1,575,092 | 3/1926 | Best | 70/373 |
| 1,656,854 | 1/1928 | Best | 70/369 |
| 2,287,175 | 6/1942 | Heyer | 70/495 |
| 2,457,650 | 12/1948 | Dyson | 70/381 |
| 3,197,985 | 8/1965 | Cosio | 70/419 |
| 3,298,211 | 1/1967 | Russell | 70/369 |
| 3,429,154 | 2/1969 | Schwartz | 70/375 |
| 3,492,842 | 2/1970 | Schlage | 70/369 |
| 3,928,991 | 12/1975 | Gaul et al. | 70/364 A |
| 4,282,731 | 8/1981 | Taksony | 70/364 A |
| 4,321,811 | 3/1982 | Ziegler | 70/356 |
| 4,328,690 | 5/1982 | Oliver | 70/369 |
| 4,356,713 | 11/1982 | Widen | 70/364 A |
| 4,478,061 | 10/1984 | Preddey | 70/358 |
| 4,603,565 | 8/1986 | Strassmeir | 70/358 |
| 4,703,638 | 11/1987 | Bergstrom | 70/369 R |
| 4,715,201 | 12/1987 | Craig | 70/369 |
| 4,732,023 | 3/1988 | Shen | 70/383 |
| 4,756,177 | 7/1988 | Widen | 70/367 A |
| 4,815,307 | 3/1989 | Widen | 70/493 |
| 4,867,598 * | 9/1989 | Winter, IV | 403/381 |
| 4,900,090 * | 2/1990 | Davis | 403/381 |
| 4,920,774 | 5/1990 | Martin | 70/367 |
| 5,016,455 | 5/1991 | Hennessy | 70/493 |
| 5,067,335 | 11/1991 | Widen | 70/495 |

(List continued on next page.)

FOREIGN PATENT DOCUMENTS 9603562 2/1996 (WO) .

*Primary Examiner*—Lynne H. Browne
*Assistant Examiner*—John B. Walsh
(74) *Attorney, Agent, or Firm*—Sughrue, Mion, Zinn, Macpeak & Seas, PLLC

(57) ABSTRACT

A removable core cylinder assembly utilizes a plurality of modular parts to create a key-removable interchangeable core which will fit all existing interchangeable core locks of this kind. The removable core cylinder assembly includes accessories of a removable face plate which covers an axial recess in the cylinder shell for the locking tab and provides shelter to the head of the cylinder plug, and which is protected from removal from the cylinder shell by two stepped portions of the cylinder plug; and a key which includes a stop at the end of the tip of the key blade.

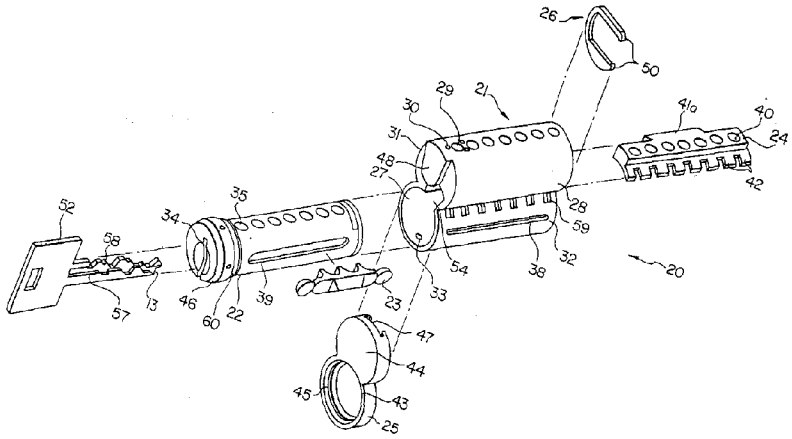

4 Claims, 5 Drawing Sheets